US008997654B2

(12) United States Patent
Miller et al.

(10) Patent No.: US 8,997,654 B2
(45) Date of Patent: Apr. 7, 2015

(54) GUIDED MUNITION

(71) Applicant: MBDA UK Limited, Stevenage (GB)

(72) Inventors: Lee Douglas Miller, Bristol (GB); George William Game, Bristol (GB)

(73) Assignee: MBDA UK Limited, Stevenage, Hertfordshire (GB)

( * ) Notice: Subject to any disclaimer, the term of this patent is extended or adjusted under 35 U.S.C. 154(b) by 0 days.

(21) Appl. No.: 13/819,467

(22) PCT Filed: Oct. 22, 2012

(86) PCT No.: PCT/GB2012/052616

§ 371 (c)(1),
(2) Date: Feb. 27, 2013

(87) PCT Pub. No.: WO2013/061042

PCT Pub. Date: May 2, 2013

(65) Prior Publication Data

US 2014/0150681 A1 Jun. 5, 2014

(30) Foreign Application Priority Data

Oct. 27, 2011 (GB) ..... 1118903.2

(51) Int. Cl.
*F42B 15/01* (2006.01)
*F41G 7/22* (2006.01)

(52) U.S. Cl.
CPC ..... *F42B 15/01* (2013.01); *F41G 7/2246* (2013.01); *F41G 7/2293* (2013.01)

(58) Field of Classification Search
USPC ..... 102/215, 214, 501, 473; 244/3.15, 3.19, 244/3.14, 3.16
See application file for complete search history.

(56) References Cited

U.S. PATENT DOCUMENTS

| | | | | | |
|---|---|---|---|---|---|
| 3,066,605 | A | * | 12/1962 | Jones | 102/228 |
| 4,157,685 | A | | 6/1979 | Gerwin | |
| 4,519,315 | A | | 5/1985 | Arszman | |
| 4,598,884 | A | | 7/1986 | Speer | |
| 4,965,453 | A | * | 10/1990 | Hoschette et al. | 250/349 |
| 5,211,356 | A | * | 5/1993 | McWilliams et al. | 244/3.15 |
| 5,261,629 | A | * | 11/1993 | Becker et al. | 244/3.22 |

(Continued)

FOREIGN PATENT DOCUMENTS

| | | |
|---|---|---|
| EP | 0 201 433 A1 | 12/1986 |
| GB | 2 025 585 | 1/1980 |

(Continued)

OTHER PUBLICATIONS

Notification of Transmittal of the International Search Report (Forms PCT/ISA/220 and PCT/ISA/210) and the Written Opinion of the International Searching Authority (Form PCT/ISA/237) dated Jan. 2, 2013, issued in corresponding International Application No. PCT/GB2012/052616. (15 pages).

(Continued)

*Primary Examiner* — Reginald Tillman, Jr.
(74) *Attorney, Agent, or Firm* — Scully, Scott, Murphy & Presser, P.C.

(57) ABSTRACT

A guided munition (10) includes a warhead (20) within the nose section (60) and processing electronics (30) arranged within the munition (10) behind the warhead (20). A plurality of sensors (50) are arranged within the nose section (60) for sensing a target. The sensors (50) are remote from but in communication with the processing electronics (30).

15 Claims, 1 Drawing Sheet

(56) References Cited

U.S. PATENT DOCUMENTS

| | | | | |
|---|---|---|---|---|
| 5,613,650 | A * | 3/1997 | Kaifu et al. | 244/3.16 |
| 6,959,893 | B1 | 11/2005 | Sadowski et al. | |
| 2011/0185935 | A1 | 8/2011 | Jennings et al. | |

FOREIGN PATENT DOCUMENTS

| | | | |
|---|---|---|---|
| GB | 2 301 420 | A | 12/1996 |
| WO | WO 2010/015860 | A1 | 2/2010 |

OTHER PUBLICATIONS

International Search Report (PCT/ISA/210) issued on Jan. 2, 2013, by the United Kingdom Patent Office as the International Searching Authority for International Application No. PCT/GB2012/052616.
Written Opinion (PCT/ISA/237) issued on Jan. 2, 2013, by the United Kingdom Patent Office as the International Searching Authority for International Application No. PCT/GB2012/052616.
United Kingdom Search Report issued on Feb. 17, 2012.

* cited by examiner

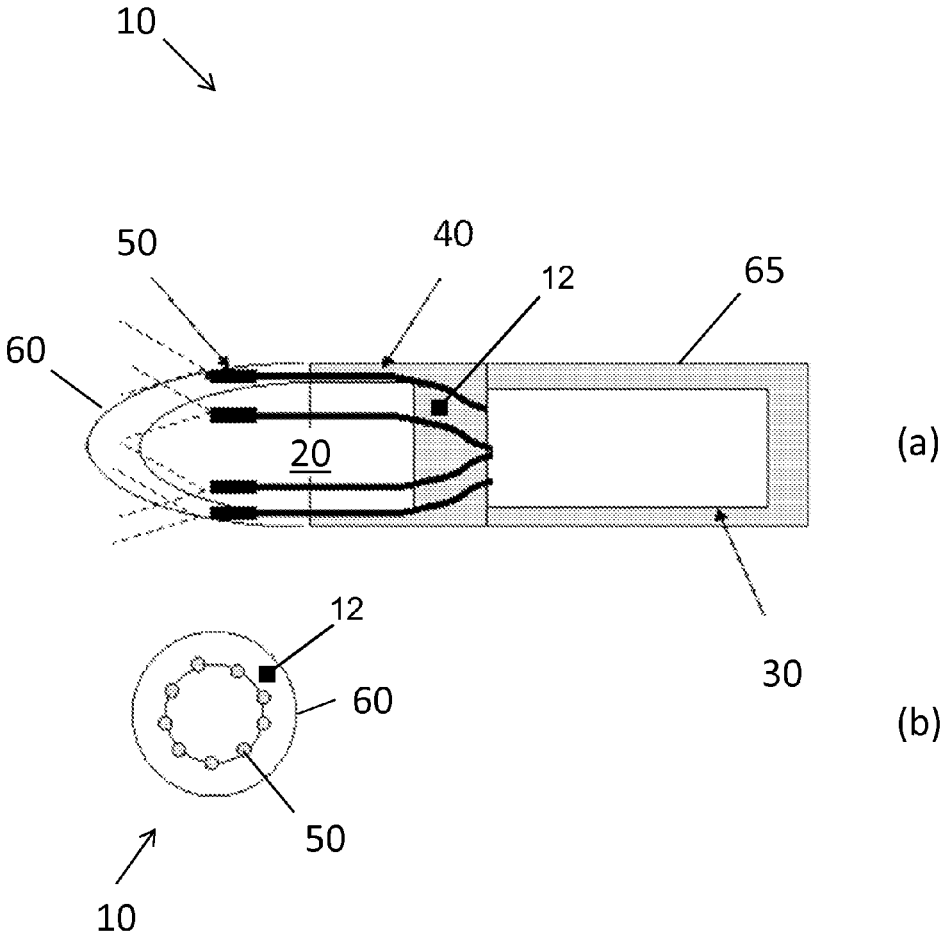
10
50
40
12
65
60
20
(a)
30
12
60
(b)
50
10

GUIDED MUNITION

FIELD OF THE INVENTION

This invention relates to the field of guided munitions, for example guided missiles. The invention is especially useful in, but is not limited to, the field of forward-acting guided munitions, for example munitions intended for penetration of hard targets (for example armoured targets).

BACKGROUND OF THE INVENTION

Guided munitions such as guided missiles typically comprise several major sub-assemblies, typically a guidance sub-assembly, a control sub-assembly, an armament sub-assembly (typically comprising a warhead and fuze) and a propulsion sub-assembly. The guidance sub-assembly determines the manoeuvres that should be executed by the munition in order for the munition to reach its target, and causes those manoeuvres to be executed via the control sub-assembly. The guidance sub-assembly includes a seeker which determines target location from sensing data. The arrangement of the major sub-assemblies within the munition varies between different types of munition, but typically the guidance sub-assembly is placed in front of the armament sub-assembly, in order to ensure that the seeker within the guidance sub-assembly is able to obtain information on target location over an uninterrupted field of view (i.e. so that the field-of-view from which information is obtained for the seeker is not obscured by the warhead).

However, placing the armament sub-assembly behind the guidance sub-assembly has a significant detrimental effect on warhead performance. For anti-armour and other forward-acting warheads, the detrimental effect is very significant. Consequently, it has been necessary to over-design warheads to ensure their effectiveness against such targets. Such over-design includes, for example, requiring additional explosive material within the warhead, which adds to the weight of the missile.

The present invention seeks to mitigate the above-mentioned problems. Alternatively or additionally, the present invention seeks to provide an improved guidance apparatus. Alternatively or additionally, the present invention seeks to provide an improved method of guidance.

SUMMARY OF THE INVENTION

The invention provides, in a first aspect, a guided munition including a nose section, the munition including (i) a warhead at least partially within the nose section, (ii) a plurality of sensors arranged within the nose section for generating sensor information for use in sensing a target, and (iii) seeker processing electronics for processing generated sensor information to provide data for use in guiding the munition to a sensed target, wherein the processing electronics are arranged behind the warhead and the sensors are remote from but in communication with the processing electronics.

Thus the seeker itself, comprising sensors and processing electronics, is no longer installed as a single unit but as a distributed sub-system, which improves warhead effectiveness particularly in the case of a forward-acting warhead which now does not have to act through hardware associated with the seeker processing electronics.

By arranging the sensors at a location remote from the processing electronics, whilst maintaining the sensors in communication with the processing electronics, the invention enables positioning of the warhead forward of the processing electronics. The sensors will generally be much smaller than the processing electronics, and so—by separating the sensors from the processing electronics—they can be positioned adjacent to (at the side of), or even in front of, the warhead and still sense over an adequate field of view, whilst allowing the warhead to be significantly further forward within the munition than would be the case if it were behind the seeker processing electronics. Since the warhead is further forward, it will be more effective, especially against armoured targets and other "hard" targets. Thus, the guided munition includes a seeker comprising two parts that are remote from (i.e. physically separated from) but in communication with each other: the sensors which are at the side of or in front of the warhead, and the processing electronics, which are behind the warhead.

The sensors may themselves include some pre-processing electronics, for example signal-conditioning electronics, but the main seeker processing electronics is positioned behind the warhead. In particular, multiple, respective sensor outputs may be assembled to provide image data, or other information indicative of the position of a target, by the seeker processing electronics behind the warhead.

In known arrangements, the seeker processing electronics are mounted within the guided munition but this may not be essential. The guided munition may be a guided missile. The guided missile may be an anti-armour missile. The guided missile may be a forward-acting missile, i.e. the guided missile may be configured so that the effects of detonation of its warhead are primarily directed forwards (i.e. in the direction in which the nose section points).

A "warhead" in the context of embodiments of the present invention is a component in a munition that provides explosive material. Thus placing the seeker processing electronics behind a warhead in a forward-acting missile means that none, or little, of the warhead's explosive material has to act through the processing electronics in the direction of travel at impact. In a forward-acting missile carrying a single warhead, all or substantially all of the explosive material of the munition will therefore be forward of the processing electronics and unimpeded by it on detonation.

The processing electronics is configured to receive information from different respective sensors and to process that information to enable generation of a guidance control signal that will guide the munition to a target. The processing electronics is arranged behind the warhead: it will be understood that the processing electronics is "behind" the warhead in the sense that it is further from the tip of the nose section than is the warhead. The processing electronics may be arranged immediately behind the warhead. The processing electronics itself may be within the nose section; alternatively, the processing electronics may be behind the nose section.

There may be, for example at least 4 sensors, at least 8 sensors, at least 12 sensors, or even more than 20 sensors. The sensors may be configured to sense infrared light. Alternatively, or in addition, the sensors may be configured to sense visible light. The sensors may be configured to sense target information over at least part of the field of view from the nose section. The sensors may be configured to image at least part of the field of view from the nose section.

The munition may include waveguides extending from the sensors to the processing electronics. The waveguides may be, for example, optical waveguides or light pipes. The sensors may be formed from the ends of the waveguides; thus, for example, the ends of the waveguides may receive electromagnetic radiation reflected from the target. The sensors may include optics, for example optics that includes lenses to collect the electromagnetic radiation and focus it into the waveguides. It may be that the waveguides extend from within the nose section back to the processing electronics; it may be that the sensors are thus in communication with the processing electronics. The waveguides may be optical fibres. In a preferred embodiment, the sensors may comprise electronics. The sensors may comprise photodetectors. The sensors may be in communication with the processing electronics via an electrical connection. The sensors may be in communication with the processing electronics via a radio-frequency (RF) signal (i.e. an RF link). The waveguides may carry the RF signal. Alternatively, the RF signal may be transmitted to the processing electronics via a wireless link, The sensor may include electronics configured to condition a signal sensed by the sensor, for example to filter the signal, for example to pass only a wavelength band of interest.

The sensors may be at the tip of the nose section; alternatively, the sensors may be arranged behind the tip of the nose section. The sensors may be arranged in front of the warhead. The sensors may be arranged adjacent to the warhead. For example, the sensors may be arranged around the inner surface of the nose section and/or the outer surface of the warhead (for example, in the case of a nose section and/or warhead that is cylindrical and of circular cross-section, in a substantially circular pattern around the inner circumference of the nose section and/or the outer circumference of the warhead).

The processing electronics may be configured to combine signals received from the sensors in order to provide data for use in guiding the munition. For example, the combined signals might be used to provide a composite representation of the field of view of all of the sensors. The composite representation may be a composite image. The processing electronics may be configured to calculate an estimated target position from the composite representation.

The munition may be configured to illuminate the target actively. Thus, the munition may further include at least one source of electromagnetic radiation 12 for illuminating a target. The electromagnetic radiation may be, for example, IR or visible light. The source may be a laser. The source or sources may be located behind the warhead. The electromagnetic radiation may be transmitted from the source or sources and emitted from the nose cone to illuminate a target. The electromagnetic radiation may be transmitted, for example, via one or more waveguides, for example one or more optical fibres. It may be that the sensors are configured to receive reflections of the emitted electromagnetic radiation from the target. It may be that the sensors are configured to filter received light in order to selectively pass the reflections to the processing electronics.

The invention also provides, in a second aspect, guidance apparatus for a guided munition that includes a nose section and a warhead within the nose section, the guidance apparatus comprising processing electronics configured to be positioned behind the warhead and a plurality of remote sensors configured to be arranged within the nose section for sensing a target such that the sensors are remote from but in communication with the processing electronics.

It will of course be appreciated that features described in relation to one aspect of the present invention may be incorporated into other aspects of the present invention. For example, the apparatus of the second aspect of the invention may incorporate any of the features described with reference to the first aspect of the invention and vice versa.

DESCRIPTION OF THE DRAWINGS

Embodiments of the present invention will now be described by way of example only with reference to the accompanying schematic drawings of which:

FIG. 1 is (a) a schematic cut-away side view of a front portion of a guided munition according to a first example embodiment of the invention, and (b) a cut-away end view looking towards the front of the same.

DETAILED DESCRIPTION

A front portion of a missile 10 according to a first embodiment of the invention is shown in FIG. 1 (the control and propulsion sub-assemblies of the missile are not shown, as they are not relevant to the invention and can be of standard design).

The front portion of the missile 10 includes a nose portion 60 and a body portion 65, which in this example is cylindrical and of circular cross-section. The cylindrical body portion 65 includes seeker processing electronics 30.

A warhead 20 is positioned in the nose portion 60 (in the example figure, warhead 20 also extends some way into the cylindrical portion 65). (For ease of illustration, the fuze for firing the warhead is not shown in FIG. 1, but it can be of standard design.)

Also within the nose portion 60 are nine sensors 50, connected individually by connections 40 to the seeker processing electronics 30. The sensors are arranged around and towards the front of the warhead 20, in this instance in a circular pattern although other patterns might be appropriate. The sensors are each arranged to detect an optical signal from part of the forward field of view of the missile; together, they cover the whole of that forward field of view. Each sensor 50 is connected to the processing electronics 30 by a connection 40, which runs from the sensor 50 in the nose cone, along the side of the warhead 20 into the cylindrical portion 65 and to the processing electronics 30.

As described previously herein, the connections 40 may comprise waveguides such as optical fibres or light pipes. The sensors 30 may be formed from the ends of the waveguides 40 which may be provided with known types of optical element such as lenses to collect electromagnetic radiation and focus it into the waveguides 40 and/or optical filters to select a wavelength band of interest. The waveguides 40 then deliver the individual signals from the sensors 30 to a spatially sensitive photodetector at the processing electronics 30, such as a detector array.

Alternatively, each sensor 50 might include pre-processing equipment such as a filter, followed by an electro-optic element (in this example a photodetector). Each sensor 50 is connected to the processing electronics 30 in this case by an electrical connection 40. When a sensor 50 detects an optical signal in the wavelength band of interest, an electrical signal is generated by the photodetector and transmitted along the electrical connection 40 from the sensor 50 to the processing electronics 30.

The pre-processing equipment might equally be provided in the electrical domain, for example by one or more electronic devices, and might provide filtering or other signal conditioning such as amplitude adjustment.

Whether signals are received over an electrical or optical connection 40, the processing electronics 30 combines the individual signals from each of the sensors 50 to provide a composite signal, corresponding to the whole field of view of the front of the missile 10, from which guidance calculations are done by the processing electronics 30 to generate a guidance control signal in the normal way.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

In a variation (not illustrated) on the above example embodiment of the invention, a laser is positioned behind the warhead 20, and emits light that is transmitted to the nose 60 of the missile 10 along further optical fibres 40. The laser light is emitted at the ends of the fibres 40 and thereby illuminates a target. Reflections of the laser light from the illuminated target are detected by the sensors 50. Active imaging of the target is thereby provided.

Thus, example embodiments of the invention make use of communication means (in the above examples a fibre-optic link) and detector array technology to enable the sensing means to be positioned at points around the perimeter of a nose section, whilst leaving the centre of the nose section to accommodate the warhead, which can therefore now be placed forward of the processing electronics. The processing electronics fuses the individual images or other sensor data into signals that can be used for guidance means. The effectiveness of the missile is enhanced thus providing improved warhead penetration against hard targets and the like.

In the above example, a communications link from the sensors to the processing electronics is achieved by transmission of an optical signal along an optical fibre 40. In alternative embodiments of the invention, the link is achieved using an RF signal. In example embodiments of the invention, the RF signal is transmitted via electrical connection 40, for example a co-axial cable. In some other example embodiments of the invention, the RF signal is transmitted via a wireless connection 40, e.g. between a transmission antenna element in connection with the sensors and a receiving antenna element in connection with the processing electronics.

In alternative embodiments of the invention, the link is achieved using a DC or low-frequency signal over an electrical connection 40.

As shown in FIG. 1, individual sensors 50 deliver their signals to the processing electronics 30 by respective connections 40. However, as long as the individual sensor signals can be differentiated, for instance by time of arrival at a detector at the processing electronics 30, the signals could alternatively be delivered to the processing electronics 30 by one or more shared connections 40. This arrangement might be useful for example where pulsed illumination of a target is provided and the sensors 50, or groups of sensors 50, are each connected to a shared connection 40 via a delay line of distinctive characteristic.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A guided munition including a nose section, the munition including (i) a warhead at least partially within the nose section, and further including a seeker, the seeker comprising:

(ii) a plurality of sensors arranged within the nose section for generating sensor information for use in sensing a target, and (iii) main seeker processing electronics for processing generated sensor information to provide data for use in guiding the munition to a sensed target, wherein the main seeker processing electronics are arranged behind the warhead and the sensors are remote from but in communication with the main seeker processing electronics, wherein the main seeker processing electronics processes generated sensor information so as to assemble information received from different respective sensors and form image data from the assembled information, and wherein the sensors are arranged adjacent to the warhead, around the inner perimeter of the nose section and/or the outer perimeter of the warhead thus leaving the centre of the nose section to accommodate the warhead.

2. A guided munition as claimed in claim 1, wherein the guided munition is a guided missile.

3. A guided munition as claimed in claim 2, wherein the guided missile is an anti-armour missile or other forward-acting missile.

4. A guided munition as claimed in claim 1, wherein each sensor includes pre-processing equipment comprising signal-conditioning electronics.

5. A guided munition as claimed in claim 1, wherein each sensor is in communication with the main seeker processing electronics by means of a respective connection.

6. A guided munition as claimed in claim 1, including one or more waveguides extending from the sensors to the main seeker processing electronics.

7. A guided munition as claimed in claim 1, wherein the main seeker processing electronics is configured to combine signals received from the sensors in order to provide a composite representation of the field of view of all of the sensors.

8. A guided munition as claimed in claim 1, wherein the munition includes at least one source of electromagnetic radiation for illuminating a target.

9. A guided munition as claimed in claim 8, in which the source(s) is located behind the warhead and the electromagnetic radiation is transmitted from the source or sources and emitted from the nose section to illuminate the target.

10. A guided munition as claimed in claim 9, in which the electromagnetic radiation is transmitted via one or more waveguides.

11. A guided munition as claimed in claim 8, in which the sensors are configured to receive reflections of the electromagnetic radiation from the target.

12. A guided munition as claimed in claim 1, wherein the sensors are configured to filter received radiation.

13. A guided munition as claimed in claim 11, wherein the sensors are configured to filter received radiation.

14. A guided munition as claimed in claim 1, in which the sensors are in communication with the main seeker processing electronics via an RF link.

15. Guidance apparatus for a guided munition that includes a nose section and a warhead within the nose section, the guidance apparatus comprising a seeker including a plurality of remote sensors and main seeker processing electronics configured to be positioned behind the warhead, wherein the plurality of remote sensors are configured to be arranged within the nose section for sensing a target such that the sensors are remote from but in communication with the main seeker processing electronics, wherein the main seeker processing electronics processes generated sensor information so as to assemble information received from different respective sensors and form image data from the assembled information, and wherein the sensors are arranged adjacent to the warhead, around the inner perimeter of the nose section and/or the outer perimeter of the warhead, thus leaving the centre of the nose section to accommodate the warhead.

* * * * *